US006254943B1

(12) United States Patent
Osbourne

(10) Patent No.: US 6,254,943 B1
(45) Date of Patent: Jul. 3, 2001

(54) IMAGE TRANSFER SHEET AND PROCESSES THEREOF

(75) Inventor: Helen A. Osbourne, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/336,969

(22) Filed: Jun. 21, 1999

(51) Int. Cl.[7] ..... B41M 5/128

(52) U.S. Cl. ..... 428/29; 156/235; 428/195; 503/201; 503/206

(58) Field of Search ..... 503/201, 206; 428/195, 913, 914, 29; 156/235

(56) References Cited

U.S. PATENT DOCUMENTS

| | | | | |
|---|---|---|---|---|
| 3,677,088 | | 7/1972 | Lang | 73/356 |
| 4,154,107 | | 5/1979 | Giezen et al. | 73/356 |
| 4,280,441 | | 7/1981 | McNeely | 116/219 |
| 4,408,557 | | 10/1983 | Bradley et al. | 116/206 |
| 4,664,735 | | 5/1987 | Pernicano | 156/240 |
| 5,674,803 | * | 10/1997 | Delaney | 503/206 |
| 6,106,910 | * | 8/2000 | Tan et al. | 428/29 |

OTHER PUBLICATIONS

Xerox "Color Ink Jet Iron–On Transfer Instructions".

* cited by examiner

*Primary Examiner*—Bruce H. Hess
(74) *Attorney, Agent, or Firm*—E. O. Palazzo

(57) ABSTRACT

A transfer sheet including a substrate; and an indicator.

16 Claims, No Drawings

IMAGE TRANSFER SHEET AND PROCESSES THEREOF

BACKGROUND OF THE INVENTION

The present invention relates to heat transfer sheeting of the type including a supported image disposed on a carrier substrate which, when properly heated, transfers the supported image to a receiver substrate such a fabric or a garment. More specifically, the present invention relates to heat transfer sheeting which includes an indicator which signals that appropriate transfer conditions, such as thermal and or pressure, including threshold temperature and minimum time duration, have been accomplished and satisfied to provide complete and high quality image transfer results.

Heat transfer sheeting is known and has been a popular means for transferring a design or reflective design onto an article, such as a garment, reference for example, heat transfer sheeting articles and methods disclosed in U. S. Pat. Nos. 5,484,644, and 4,248,500, the disclosures of which are incorporated herein by reference in its entirety.

A common problem with heat transfer sheeting is that operators frequently inconsistently apply heat to the transfer sheeting resulting in, for example, incomplete transfer of the image when the heating and or pressure is too low or too brief in duration, or a damaged or burned image when the heating and or pressure is too high or too long in duration.

The present invention provides a simple solution to the aforementioned problems by providing a thermally sensitive and or time sensitive indicator which indicates when satisfactory thermal, pressure, and durational conditions have been achieved so that high quality and high reproducibility of transferred images can be consistently obtained.

PRIOR ART

In U.S. Pat. No. 4,280,441, issued Jul. 28, 1981, to McNeely, there is disclosed a temperature indicator including a backing strip with an embossed well stamped therein. The well contains a matrix carrier which is impregnated with a thermally responsive fusible chemical. The bottom of the well is painted a bright color. The impregnated matrix is placed over and substantially covers the colored bottom of the well. The top of the well is covered by a transparent film. At a temperature below a predetermined level, the colored bottom of the well is substantially invisible due to the impregnated matrix being opaque, and at temperatures above such predetermined level, the colored bottom of the well is clearly visible due to the transparency of the impregnated matrix upon melting of the chemical.

In U.S. Pat. No. 4,154,107, issued May 15, 1979, to Giezen et al., there is disclosed a time-temperature device having an indicator layer which visually indicates the lapse of a time temperature integral. A signaling component is provided which, upon contact with the indicating layer, causes the indicator layer to undergo a visually perceptive change. The device further includes a reservoir for the signaling component, including a first backing and adhesive layer containing an adhesive substance. The adhesive layer is positioned between the indicating layer and the first backing.

In U.S. Pat. No. 3,677,088, issued Jul. 18, 1972, to Lang, there is disclosed a thermometer having a thermally sensitive substance deposited on a thermally conductive sheet, and an overlying transparent film carrying indicator means which are superpositionably registrable with the thermally responsive substance for communicating therewith to denote specified temperatures upon change of state of the substance is provided with a readily removable flexible shield interposed between the thermally responsive substance and indicator means to prevent communication and reaction between the two until the thermometer is actually required for use. The shield is readily removably adhesively secured to the transparent film and can be peelably removed therefrom by pulling action applied digitally to a pull tab at one end of the shield. Concurrent with peeling of the shield from the transparent film, the latter is pressed against the thermally conductive sheet to position the indicator means in proper overlying communicating registration with the temperature responsive substance on the carrier sheet.

In U.S. Pat. No. 4,664,735, issued May 12, 1987, to Pericano, there is disclosed a heat transfer sheeting combination of the type for being applied to an article to imprint a design thereon including a substrate, a design coating disposed on the substrate, and an adhesive layer disposed on the design coating for adhesively securing the design coating to the article. The combination is characterized by the substrate including a releasing agent coat disposed between the design coating and the substrate for facilitating the removal of the substrate from the design coating after the application thereof onto the article.

In U.S. Pat. No. 4,408,557, issued Oct. 11, 1983, to Bradley et al., there is disclosed a timer and storage conditions indicator for indicating the passage of a predetermined length of time under predetermined ambient physical environmental conditions, in which a carrier mixture is contained in a relatively confined area above a base layer. An absorptive layer is disposed on the base layer and accepts the carrier mixture at a predetermined rate. A barrier means is disposed between the carrier mixture and the absorptive layer, and the removal of the barrier activates the timer. Transfer means such as a capillary tube or a second absorptive layer may be disposed between the carrier mixture and the first mentioned absorptive layer.

The following references are of interest and disclose, for example, time-temperature indicators, compositions, and devices, and include U.S. Pat. Nos.: 3,932,134; 3,942,467; 3,946,611; 3,946,612; 3,966,414; 3,980,581; 3,981,683; 3,996,007; 4,042,336; and 4,154,107.

The disclosure of the above mentioned patents are incorporated herein by reference in their entirety. Appropriate components and processes of these patent applications may be selected for the articles and processes of the present invention in embodiments thereof.

SUMMARY OF THE INVENTION

Embodiments of the present invention, include:

A transfer sheet comprising a substrate; and an indicator; and

A process comprising:

treating for a time an indicating transfer sheet with an image on one surface together with a receiver substrate, wherein the image is transferred from the transfer sheet to the receiver sheet and wherein an indicating component of the indicating transfer sheet changes color when the image transfer is substantially complete.

These and other aspects are achieved, in embodiments, of the present invention as described and illustrated herein.

DETAILED DESCRIPTION OF THE INVENTION

The present invention provides in embodiments a useful printing article comprising: a transfer sheet comprising a substrate; and an indicator.

In use applications the substrate further comprises a transferable image layer wherein the transferable image layer resides on one surface of the substrate. The combined image layer and substrate are adapted to transfer the image layer from the substrate to a receiver sheet upon appropriate application of energy in the form of, for example, heat, pressure, light, or combinations thereof. The image layer transfer can be effected, for example, heating the substrate at from about 300 to about 450° F. for about 10 seconds to about 5 minutes. A suitable image layer can be, for example, a transferable and fusible ink composition comprised of a resin binder and a colorant. The image layer can be comprised entirely of a printed image deposited on the transfer sheet substrate. Alternatively, the image layer can be comprised of a printed image deposited on the transfer sheet substrate in combination with material, for example, a polymeric transferable coating or release layer, residing on the transfer sheet prior to the deposition of the image layer.

In embodiments, the indicator can reside on the substrate surface opposite the image layer. Preferably, the indicator remains with the substrate and is not transferred to the receiver sheet nor transferred to or removed by the heat source, such as an iron or a press. In other embodiments, the indicator can reside on the image bearing surface of the substrate, or the indicator can be contained within either or both the substrate and the image layer. When the indicator is contained in the substrate, it is preferable that the substrate, or a suitable substrate coating, be semi- or completely transparent so that the color change of the indicator can be readily observed by the operator-user. The integral indicator can be obtained, for example, during the manufacture of the substrate, wherein the indicator can be incorporated into the substrate thereby providing a more accurate indication of the temperature of the substrate and the image layer, and obviating the need to separately coat or otherwise protect the indicator from inadvertent removal or mechanical damage by the heat source.

The image layer can be comprised of known transferable image materials, including an ink comprised of a colorant. Other transferable image materials are known, for example xerographically prepared images comprised of, for example, a developed xerographic toner comprising a resin binder and a pigment or dye, or combinations thereof, or a developed ink jet ink image comprising a colorant comprised of a dye or pigment or combination of one or more dyes and pigments.

The indicator includes, for example, a component or compound which is thermally sensitive, pressure sensitive, light sensitive, or mixtures thereof. The indicator can include a thermochromic compound, that is, the indicator can contain, for example, a thermally sensitive constituent material or materials which change color, for example, turn from colorless to colored, from one color to a different color, or from one color to colorless, when heated and or compressed, for example, with pressure, for a sufficient period of time and as illustrated herein.

Thermally sensitive compounds, such as thermochromic compounds, include for example, compounds which reversibly or irreversibly change color when subjected to changes in temperature. For example, U.S. Pat. No. 4,142782, the disclosure of which is incorporated herein by reference in its entirety, discloses display arrangements useful as art forms and useful in advertising applications that can be constructed by coating areas of a surface of a support with differently colored compositions, each of which is capable of appearing as being of one color at one temperature and as being of another color at a different temperature. The compositions should be differently colored at least one temperature. The color-temperature effects achieved are obtained through the use of reversible thermochromic compounds or compositions.

In embodiments, the indicator is preferably comprised of irreversible thermochromic compounds which compounds irreversibly change color when a threshold temperature or relatively narrow temperature range has been achieved or exceeded, reference for example, U.S. Pat. No. 5,583,223, the disclosure of which is incorporated herein by reference in its entirety, and which reference discloses thermochromic compounds, their preparation and the use thereof. Alternatively, the thermochromic compounds can also be photochromic, reference for example, U.S. Pat. No. 3,584,934, the disclosure of which is incorporated herein by reference in its entirety, where a thermochromic compound which is also photochromic is exposed to light of particular wavelength(s), for example, ultraviolet and visible light, the thermochromic color change can be reversed. Similarly, pressure sensitive compounds or bathochromic compounds include, for example, compounds which reversibly, or preferably irreversibly, change color when a pressure level range has been achieved or exceeded.

The aforementioned thermally sensitive, pressure sensitive, light sensitive, and the like sensitive compounds, are related by the common feature of undergoing a reversible or irreversible color change when subjected to sufficient energy in the form of heat, mechanical pressure, irradiation, and or a combination thereof. Other suitably sensitive compounds are envisioned which also provide an indicating color change resulting from, for example, one or more chemical reactions such as crosslinking, ring opening, elimination reactions leading to for example extended conjugation, coordinative/associative reactions, dissociative reactions, pyrolysis, decomposition, and the like color producing or color reducing reactions or physical changes, leading to products or by-products which produce a satisfactory color change. For example, certain colorless chemically modified cellulosics and polysaccharides when heated can produce a range of colors and color changes, such as tans, browns, and black depending upon, for example, the temperature, duration or length of exposure, the concentration and dispersion of resulting color producing compounds, and the like considerations. These and other color producing and color abatement principles are readily evident to one of ordinary skill in the art of, for example, organic, polymer, and organometallic chemistry, and which principles can be adapted to color change schemes in embodiments of the present invention.

The indicator can include a pressure sensitive or bathochromic compound, that is, the indicator can contain, for example, a pressure sensitive constituent material or materials which changes color, for example, turns from colorless to colored, from one color to a different color, or from a color to colorless, when compressed with, for example, mechanically applied pressure from a pressure roller, for a sufficient period of time and as illustrated herein to effect a satisfactory color change and concomitant complete image transfer. Examples of pressure sensitive compounds include thermotropic liquid crystals.

The indicating compound or indicating component of the indicator or indicator mixtures thereof can be present in an amount of from about 0.001 to 100 percent by weight based on the total weight of the indicator. The indicator can optionally include a binder resin and the binder resin can optionally include an indicating compound or component which is covalently bound to the binder resin.

The indicator can be printed or deposited on the substrate, for example, on the non-image transfer side of the substrate, with known and conventional methods, such as spraying, painting or printing, for example, using xerography, ink jet printing methods, and the like marking and deposition methods. The indicator can be in any suitable form or pattern such as a uniform array of dots, grid lines, stripes, and the like indicia, and preferably wherein the surface coverage of the substrate by the indicator is maximized and where the cost of ingredients used to form the indicator and the cost of application of the indicator are minimized. Thus as illustrative examples, an array of small dots, for example, of about 0.5 to about 2 millimeters in diameter, or grid of lines, for example, of about 0.5 to about 2 millimeters in thickness, which are visible to the human eye, before, after, or during the color change, and which markings cover substantially the entire sheet, and where the lines or dots are spaced apart by, for example, 0.5 to about 5.0 centimeters, provide to the operator-user a satisfactory distribution and placement of indicating marks for typical applications. The shape, appearance, size, and spacing of the indicating marks can be readily modified to accommodate a variety of use applications.

In a preferred embodiment, the indicator changes color when heated for a time of from about 0.1 second to about 10 minutes, preferably from about 1.0 second to about 5 minutes, more preferably from about 10 seconds to about 2 minutes, and most preferably from about 10 seconds to about 1 minute. Heating can be accomplished by known methods including induction and convection, such as a flat iron, a heated roller, microwave irradiation, infrared irradiation, and the like methods, and combinations thereof.

In embodiments, the indicator can additionally change color when satisfactorily compressed, and which compression energy approximates the analogous heating process, for a time of from about 0.1 seconds to about 10 minutes, and preferably from about 0.5 second to about 5 minutes, and more preferably from about 1 second to about 1.0 minute. Compression can be accomplished by known methods including compression rollers, vises, presses, and the like methods, and combinations thereof.

The substrate can be material which is adapted to receive and release the image layer, and receive and support an indicator. The substrate is preferably adapted to exceed the demands placed upon it for the image transfer step, for example, withstand the thermal and pressure energy delivered to substrate to effectuate transfer. Suitable substrates include, for example, paper, transparency materials, plastics, polymeric films, metals, treated cellulosics, wood, metals, and mixtures thereof, and optionally a release coating layer. The release coating layer can be on one or both sides of the substrate. The coating layer can serve several functions in addition to an image release layer, for example, including as a protective layer for the indicator and indicating component, and a non-stick layer for the non-image side of the substrate which non-stick layer facilitates, for example, rapid heat transfer and uniform heat distribution to the substrate and the image layer and rapid release of the heating and or pressure elements employed to effectuate image layer transfer.

The present invention in embodiments provides a process comprising treating for a time an indicating transfer sheet with a transferable image layer on one surface together with a receiver substrate, wherein the image layer is transferred from the indicating transfer sheet to the receiver substrate, such as a printable substance or sheet, and wherein the indicating component of the indicating transfer sheet changes color when the image transfer from the transfer sheet to the receiver is substantially complete. Substantially complete means complete or nearly complete image transfer, for example, with from about 98 percent to about 99.9 percent image transfer so that a high quality transfer and image result on the receiver. The color change event of the indicating component is designed to closely correspond only to those areas of the transfer sheet that have been properly activated energetically for image transfer by sufficient transfer force, such as by heat, pressure, or light energy, and wherein image transfer is substantially complete. For those areas of the transfer sheet where image transfer to the receiver sheet is incomplete, there is correspondingly little or no observable color change. The absence of color change therefore visually alerts or signals to the operator-user that additional transfer force is required to complete a uniform or monolithic transfer of the image layer to the receiver material. Transfer force as used herein includes, for example, the above mentioned factors which facilitate transfer and also cause the indicator component to undergo a noticeable color change, and include heating, irradiation, pressure, and the like energy transfer methods, and combinations thereof.

The transfer sheet substrate can be, for example, paper, transparency materials, plastics, polymeric films, metals, treated cellulosics, wood, metals, and mixtures thereof, and optionally a release coating layer. A preferred transfer sheet is relatively non-insulating and readily dissipates or transfers heat. The receiver substrate or sheet can be, for example, paper, transparency materials, plastics, polymeric films, metals, treated cellulosics, wood, metals, cut and finished textiles, such as T-shirts, sweat shirts, and the like, and mixtures thereof. A preferred transfer sheet is comprised of a substrate comprised of paper or a polymer film, for example with a nominal thickness of from about 0.01 millimeter to about 2 millimeters. The nominal thickness of the indicator, that is as the indicator layer, can be, for example, from about 0.01 millimeter to about 2 millimeters.

The aforementioned treating can be accomplished by, for example, heat, light, pressure, and or combinations thereof. The treating can be accomplished with heat at from about 300° F. to about 450° F., for about 10 seconds to about 5 minutes, and preferably the heating can be at from about 325° F. to about 425° F., for about 15 seconds to about 40 seconds, for example, with commercially available heat presses with a large and relatively constant temperature, that is high heat capacity, heating surface and, for example, from about 1 to about 4 minutes for hand held irons with a relatively small and highly variable temperature, that is lower heat capacity, heating surface. The treating can also be accomplished, for example, alone or in combination with pressure from about 0.01 pound per square inch to about 100 pounds per square inch, for about 10 seconds to about 5 minutes, and preferably from about 1.0 pound per square inch to about 50 pounds per square inch, for about 15 seconds to about 2 minutes. The treating can also be accomplished, for example, alone or in combination with irradiation, for example, in the infrared, ultraviolet, and nearby wavelengths, where the intensity and duration of the irradiation will depend upon the formulation and properties of the image transfer layer, the transfer substrate, and the indicating composition, and the like considerations. Suitable irradiation color indicating compounds include known triphenyl methane derivatives, azo dyes, diazonium compounds, and the like compounds.

The invention will further be illustrated in the following nonlimiting Examples, it being understood that these Examples are intended to be illustrative only and that the invention is not intended to be limited to the materials, conditions, process parameters, and the like, recited herein. Parts and percentages are by weight unless otherwise indicated.

COMPARATIVE EXAMPLE I

Image Transfer Accomplished with Conventional Transfer Sheet:

When a commercially available transfer sheet was imaged with either a xerographic or an ink jet printer and thereafter used in a manufactures recommended thermal transfer "iron-on" procedure, there was considerable instances of incomplete image transfer, for example, because of uncertainties associated with the extent, duration, and completeness of the heating and associated transfer, and concomitant poor or unsatisfactory image quality of the transferred images.

EXAMPLE I

Fabrication of Indicating Transfer Sheet Article:

An exemplary procedure for preparing the indicating composition, application of the indicating composition to a transfer sheet, and use of the indicating transfer sheet in an image transfer application follow.

Formulation of an Indicator:

An indicating composition is prepared by mixing a thermochromic compound which has a known color change event in the range of from about 300° F. to about 450° F. with a thermoplastic or thermoset resin. Suitable indicating compounds are, for example, those mentioned in the above prior art section.

Applying the Indicating Composition to the Transfer Sheet:

The above resulting indicating mixture is applied to, for example, a commercially available thermal transfer sheet, such as from Xerox Corporation or Fotowear, Inc. (Pennsylvania), by any suitable marking means, such as painting or printing methods, to obtain an indicating transfer sheet which is suitable for immediate use or which sheet when satisfactorily dried can be stacked and stored for use at a later time.

Transferring Images with the Indicating Transfer Sheet Article:

An exemplary image transfer was accomplished using the indicating transfer sheet prepared above and in accordance with the manufacturer's iron-on collateral instructions, for example, using a preheated hand iron, applying the image formed with an ink jet printer in inversion mode, to a suitable surface such a cotton based fabric, and accomplishing the transfer with a suitable thermally insulating underlying surface such as a Formica® support surface or related support surfaces. The heated iron was applied as directed and after the indicator under went complete color change the transfer sheet and receiver ensemble were allowed to cool for one minute whereupon the transfer sheet was peeled away from the receiver with the result that a complete image transfer resulted. Thus, the present indicating transfer sheet enables highly reproducible and high quality color image transfers onto suitable receiver materials.

Other modifications of the present invention may occur to one of ordinary skill in the art based upon a review of the present application and these modifications, including equivalents thereof, are intended to be included within the scope of the present invention.

What is claimed is:

1. A transfer sheet comprising:

a substrate;

an image layer which resides on one surface of the substrate; and an indicator integral with the substrate; wherein the transfer sheet is adapted to transfer the image from the substrate to a receiver sheet and the indicator remains with the substrate and the indicator changes color to indicate image transfer.

2. A sheet in accordance with claim 1, wherein the indicator resides on the surface opposite the image layer.

3. A sheet in accordance with claim 1, wherein the image layer is comprised of an ink comprised of a colorant.

4. A sheet in accordance with claim 1, wherein the indicator comprises a component or compound which is thermally sensitive, pressure sensitive, light sensitive, or mixtures thereof.

5. A sheet in accordance with claim 1, wherein the indicator comprises an indicating compound or component present in an amount of from about 0.001 to 100 percent by weight based on the total weight of the indicator.

6. A sheet in accordance with claim 1, wherein the indicator changes color when heated for a time of from about 0.1 second to about 10 minutes and above from about 300° F. to about 450° F.

7. A sheet in accordance with claim 1, wherein the indicator changes color when compressed for a time of from about 0.1 second to about 10 minutes and above from about 300° F. to about 450° F.

8. A sheet in accordance with claim 1, wherein the indicator comprises a resin binder and an indicating compound or compounds.

9. A sheet in accordance with claim 1, wherein the substrate is selected from the group consisting of paper, transparency materials, plastics, polymeric films, metals, treated cellulosics, wood, metals, and mixtures thereof, and optionally a release coating layer.

10. A sheet in accordance with claim 1, wherein the substrate is a polymer film.

11. A sheet in accordance with claim 1, wherein the thickness of the substrate is from about 0.01 millimeter to about 2 millimeters.

12. A sheet in accordance with claim 1, wherein the thickness of the indicator is from about 0.01 millimeter to about 2 millimeters.

13. A process comprising:

treating with heat, light, pressure, or combinations thereof for a sufficient time an indicating transfer sheet with an image on one surface of the sheet together with a receiver substrate, wherein the image is transferred from the transfer sheet to the receiver sheet and wherein an indicating component of the indicating transfer sheet changes color when the image transfer to the receiver is substantially complete, and wherein the indicator remains with the substrate.

14. A process in accordance with claim 13, wherein said treating is accomplished with heat at from about 300° F. to about 450° F., for about 10 seconds to about 5 minutes.

15. A process in accordance with claim 13, wherein said treating is accomplished with pressure from about 0.01 pound per square inch to about 30 pounds per square inch, for about 10 seconds to about 5 minutes.

16. A process in accordance with claim 13, wherein the indicator comprises a compound that is thermally sensitive, pressure sensitive, irradiation sensitive, or combinations thereof, and is present in an amount of from about 0.01 to about 99.9 weight percent based on the total weight of the indicator, and optionally a binder resin.

* * * * *